United States Patent [19]

Coenen

[11] 4,209,858

[45] Jul. 1, 1980

[54] SAFETY HELMET

[75] Inventor: Michel J. Coenen, Rijswijk, Netherlands

[73] Assignee: Coenen Benelux B. V., The Hague, Netherlands

[21] Appl. No.: 874,676

[22] Filed: Feb. 2, 1978

[30] Foreign Application Priority Data

Apr. 25, 1977 [NL] Netherlands ..... 7704517

[51] Int. Cl.[2] ..... A42B 3/02; A61F 9/06

[52] U.S. Cl. ..... 2/412; 2/6; 2/10; 2/414; 2/425; 2/411; 2/417

[58] Field of Search ..... 2/410–425, 2/427, 451, 453, 5, 6, 9, 10

[56] References Cited

U.S. PATENT DOCUMENTS

| | | | |
|---|---|---|---|
| 2,578,171 | 12/1951 | Bub | 2/10 X |
| 2,618,780 | 11/1952 | Cushman | 2/410 |
| 2,631,286 | 3/1953 | Bowers | 2/10 X |
| 3,127,616 | 4/1964 | Schueller | 2/6 |
| 4,008,949 | 2/1977 | Luna | 2/410 |

FOREIGN PATENT DOCUMENTS

| | | |
|---|---|---|
| 2222033 | 10/1974 | France . |
| 946473 | 1/1964 | United Kingdom . |

*Primary Examiner*—Louis Rimrodt

*Attorney, Agent, or Firm*—Sughrue, Rothwell, Mion, Zinn and MacPeak

[57] ABSTRACT

A crash helmet such as for use by motorcylists having an inner shell of shock-absorbing material and an outer shell and visor which are constructed as a single integral piece of transparent hard plastic material which fittingly surrounds the greater part of the inner shell. The outer and inner shells are connected to hinges transverse to the side portion of the helmet.

4 Claims, 3 Drawing Figures

SAFETY HELMET

The invention relates to a safety helmet comprising an inner shell, an outer shell and a visor.

In case of known safety helmets of this kind the visor consists of a separately manufactured transparent part which is connected to the outer shell either rotatably or not. The outer shell is formed by a tinted hard synthetic resin (e.g. polyethylene or polycarbonate) and extends itself over the whole outer surface of the inner shell. For manufacturing the outer shell a very expensive injection moulding die is required which is assembled from various parts. Normally the outer shells are delivered in a number of various colours. When changing from one colour to the other rather much loss of material arises when injection moulding. To limit these losses one will try for making a great number of shells (e.g. more than 3000) in one colour without interruption. These have to be stocked for which much space is needed.

The invention aims to avoid these disadvantages and to provide a safety helmet of the type mentioned above, with which the visor and the outer shell can be simultaneously manufactured of a transparent synthetic resin in a rather simple injection moulding die.

According to the invention to this end the outer shell and the visor consist of one piece transparent synthetic resin, which piece is connected to the inner shell by at least one hinge provided transverse to the side section of the helmet.

Starting from a safety helmet with two hinges it is preferred that each of said hinges consists of a sleeve extending through the outer shell and being connected to a strip extending through the inner shell, the end of said strip opposite to the sleeve being provided with a fastening member for a chin-strap.

In view of the transparency properties of the outer shell the outer surface of the inner shell which usually consists of foam will be provided with a finishing layer. It has appeared that for such a finishing nylon flakes can be used in a very simple way. According to a method known per se the inner shell is covered with an electrically loaded adhesive and the flakes which are provided with an opposite electrical loading are drawn to the adhesive layer.

The flakes are covering the edges of the inner shell as well so that it is no longer necessary that the size adjusting lining provided in the inner shell extends itself over the edges of the inner shell.

By this the possibility is obtained to provide very simple size adjusting lining pieces. According to the invention the inner surface of the inner shell is provided with recesses in which size adjusting lining pieces are fastened. This also is a not unimportant cost saving factor.

Now the invention will be further described by means of the figures.

The shown safety helmets comprise an inner shell 1 of foam of a synthetic resin (e.g. polystyrene), a transparent outer shell 2 of a hard synthetic resin (e.g. polycarbonate) and a visor 3 which forms one piece with the outer shell and is manufactured together with the outer shell of the same material by means of injection moulding.

Figure 1:
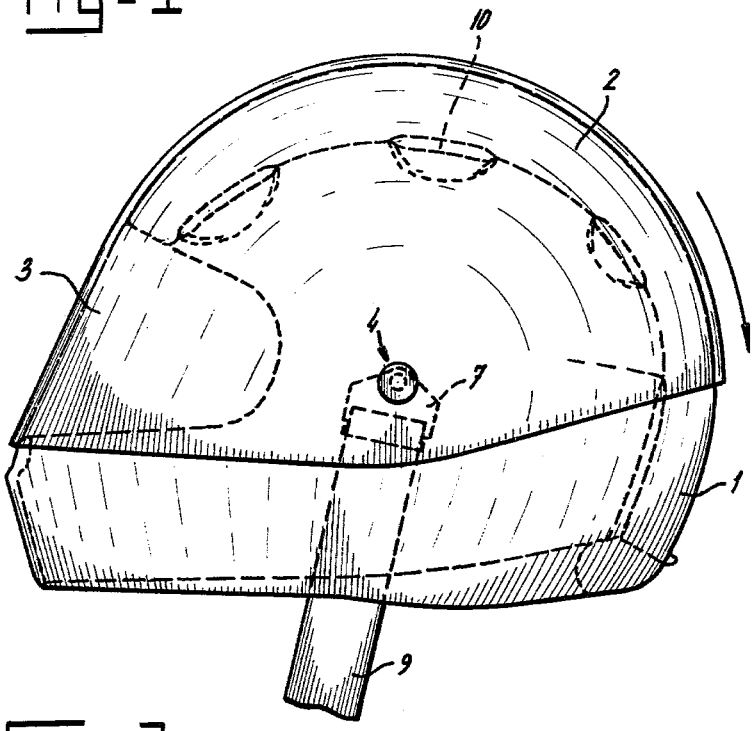
FIG. 1 shows a side view of a safety helmet according to the invention, with chin piece.
Figure 2:
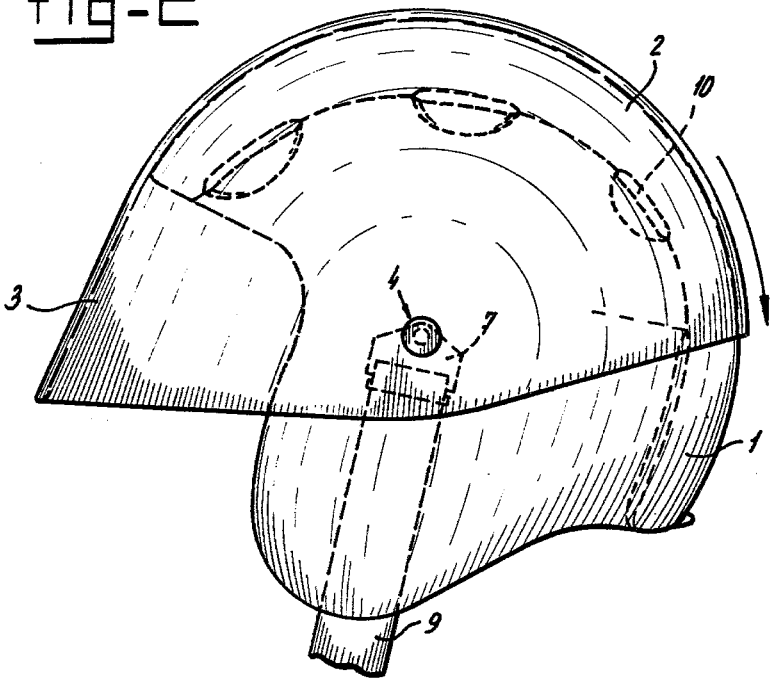
FIG. 2 shows a side view of a safety helmet according to the invention, without chin piece.
Figure 3:
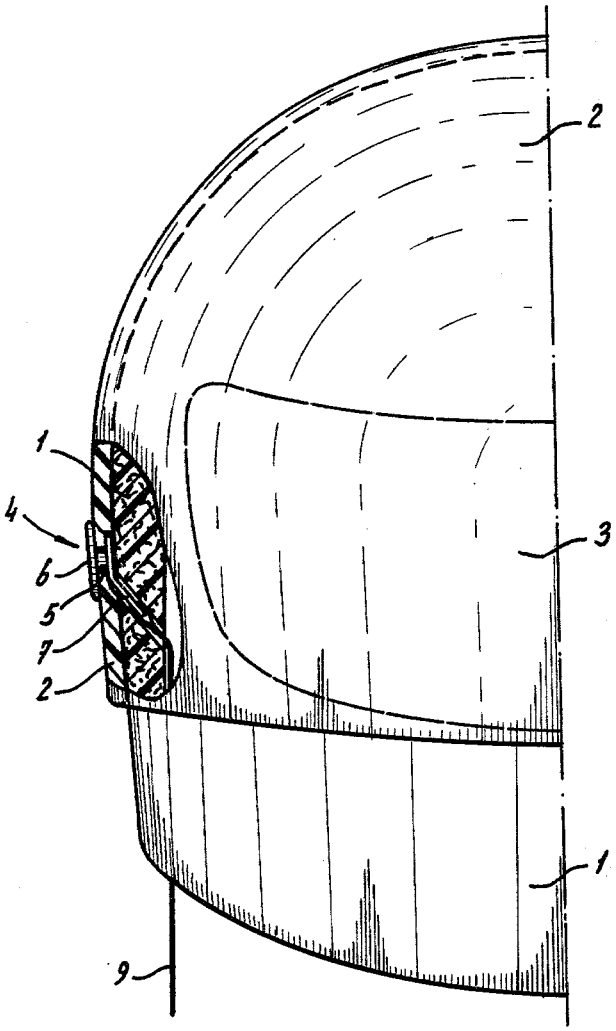
FIG. 3 shows a front view of the helmet according to FIG. 1 partly in section.

The unit formed by the outer shell and the visor is connected to the inner shell by means of two hinges 4. The axis of those hinges extend transverse to a side section of the helmet. The curve of the inner and outer shell with respect to the axis of the hinges is chosen such that the outer shell with visor can be swung over the inner shell over a given distance. This distance corresponds about with the height of the visor. By swinging the outer shell with visor from the position according to the FIGS. 1 and 2 in the direction of the arrow, the sight opening of the helmet is made free and in fact the visor is forming the front part of the outer shell.

The hinges consist of a sleeve 5 extending through the transparent outer shell and being sealed at the outer end by a screw 6 and being pivoted to a metal strip 7 at the inner end. This extends obliquely through the material of the inner shell and ends in a fastening buckle for a chin strap 9.

The outer surface of the inner shell is provided with a not shown layer of nylon flakes of the desired colour. This material also covers the edges of the inner shell, so that the size adjusting lining in the inner shell needs not to be used for covering these edges. For this reason very simple size adjusting lining pieces will suffice, which in the shown embodiment consist of nylon pieces 10 which are glued into recesses in the inner shell.

In connection with the transparancy properties of the outer shell with visor the colour of the helmet is mainly determined by the nylon flakes on the inner shell.

The transparent unit 2, 3 can be manufactured in a rather simple injection moulding die in one part.

The possibility is present to connect the outer shell with the inner shell by means of only one hinge 4. In the visor louver openings can be provided.

I claim:

1. A motorcyclist's crash helmet comprising an inner shell of shock-absorbing material, a protective outer shell made of a hard plastic material, said outer shell fittingly surrounding the greater part of the inner shell in the lowered position and having a visor portion wherein said outer shell and said visor are formed of a single piece of transparent plastic, said outer shell being connected to said inner shell by at least one hinge transverse to the side portion of the helmet.

2. Safety helmet according to claim 1, provided with two hinges, characterized in that each of said hinges consists of a sleeve extending through the outer shell and being connected to a strip extending through the inner shell, the end of said strip opposite to the sleeve being provided with a fastening member for a chin-strap.

3. Safety helmet according to claim 1 or 2, characterized in that the outer surface of the inner shell which consists of foam material is finished with nylon flakes.

4. Safety helmet according to claim 3, characterized in that the inner surface of the inner shell is provided with recesses in which size adjusting pieces are fastened.

* * * * *